US010711418B2

(12) United States Patent
Palicki et al.

(10) Patent No.: US 10,711,418 B2
(45) **Date of Patent: *Jul. 14, 2020**

(54) SNOW THROWER WITH ELECTRONIC CONTROLS

(71) Applicant: Briggs & Stratton Corporation, Wauwatosa, WI (US)

(72) Inventors: Brandon Palicki, Fort Atkinson, WI (US); James Radwill, Racine, WI (US); Harold Redman, Wauwatosa, WI (US); Daniel Steinike, Wauwatosa, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 150 days.

This patent is subject to a terminal disclaimer.

(21) Appl. No.: 15/871,887

(22) Filed: Jan. 15, 2018

(65) Prior Publication Data

US 2018/0135264 A1 May 17, 2018

Related U.S. Application Data

(63) Continuation of application No. 14/853,748, filed on Sep. 14, 2015, now Pat. No. 9,903,079.

(51) Int. Cl.
*E01H 5/04* (2006.01)
*E01H 5/09* (2006.01)

(52) U.S. Cl.
CPC ..... *E01H 5/045* (2013.01); *E01H 5/09* (2013.01); *E01H 5/098* (2013.01)

(58) Field of Classification Search
CPC .. E01H 5/04; E01H 5/045; E01H 5/09; E01H 5/098; A01D 43/087
See application file for complete search history.

(56) References Cited

U.S. PATENT DOCUMENTS

| | | | |
|---|---|---|---|
| 3,570,641 | A | 3/1971 | Lefeuvre et al. |
| 4,205,468 | A | 6/1980 | Greider |
| 4,862,607 | A | 9/1989 | Wacker |
| 5,444,927 | A | 8/1995 | Sosenko |
| 6,499,238 | B2 | 12/2002 | Kluck et al. |
| 6,662,477 | B2 | 12/2003 | Dowe et al. |
| 7,032,333 | B2 | 4/2006 | Friberg et al. |
| 7,347,013 | B2 | 3/2008 | Deschler et al. |
| 7,624,521 | B2 | 12/2009 | White et al. |
| 7,703,223 | B2 | 4/2010 | Walker et al. |
| 8,016,098 | B2 | 9/2011 | Saiia |
| 8,938,894 | B2 | 1/2015 | Raasch et al. |
| 9,096,981 | B2 | 8/2015 | Wians et al. |
| 9,290,897 | B2 | 3/2016 | Schisel et al. |
| 9,340,938 | B2 | 5/2016 | Ferrell et al. |
| 9,399,846 | B2 | 7/2016 | Friberg |

(Continued)

*Primary Examiner* — Jamie L McGowan
(74) *Attorney, Agent, or Firm* — Foley & Lardner LLP

(57) ABSTRACT

A snow thrower includes a body, a chute rotatable relative to the body about a vertical axis, wherein the chute is configured to discharge snow from the snowthrower, a chute motor for rotating the chute, and a chute position user interface. The chute motor is electrically controlled to rotate the chute in response to a first input duration to the chute position user interface and to rotate the chute in response to a second input duration to the chute position user interface. The chute motor ceases operation after the first input duration and the chute motor continues operation after the second input duration.

14 Claims, 4 Drawing Sheets

(56) References Cited

U.S. PATENT DOCUMENTS

| | | | | |
|---|---|---|---|---|
| 9,903,079 | B2 * | 2/2018 | Palicki | E01H 5/045 |
| 2006/0086009 | A1 | 4/2006 | Kuroiwa et al. | |
| 2006/0096134 | A1 | 5/2006 | Mercer et al. | |
| 2008/0209771 | A1 | 9/2008 | Jerger et al. | |
| 2014/0090278 | A1 | 4/2014 | Ricketts | |

* cited by examiner

SNOW THROWER WITH ELECTRONIC CONTROLS

CROSS-REFERENCE TO RELATED APPLICATIONS

This application is a continuation of U.S. patent application Ser. No. 14/853,748, filed Sep. 14, 2015, which is incorporated herein by reference in its entirety.

BACKGROUND

The present invention relates generally to the field of snow throwers, and more particularly, to the field of electronic controls for snow throwers.

SUMMARY

One embodiment of the invention relates to a snow thrower including a body, a chute rotatable relative to the body about a vertical axis, where the chute is configured to discharge snow from the snow thrower, a chute motor for rotating the chute, and a chute position user interface. The chute motor is electrically controlled to rotate the chute in response to a first input duration to the chute position user interface and to rotate the chute in response to a second input duration to the chute position user interface. The chute motor ceases operation after the first input duration and the chute motor continues operation after the second input duration.

Another embodiment of the invention relates to a snow thrower including a body, a chute rotatable relative to the body about an axis, where the chute is configured to discharge snow from the snow thrower, a motor for rotating the chute, and a chute position user interface. The motor is electrically controlled to rotate the chute in response to a first input duration to the chute position user interface and is electrically controlled to rotate the chute in response to a second input duration to the chute position user interface. The motor ceases operation after the first input duration and the motor continues operation after the second input duration.

Another embodiment of the invention relates to a snow thrower including a body, a chute rotatable relative to the body about an axis, where the chute is configured to discharge snow from the snow thrower, a motor for rotating the chute, and a chute position user interface. The motor is configured to rotate the chute a first predetermined angular distance in response to receiving a first input from the chute position user interface and is configured to rotate the chute to a second predetermined angular distance greater than the first predetermined angular distance in response to receiving a second input from the chute position user interface.

Another embodiment of the invention relates to a snow thrower including a body, a chute rotatable relative to the body about an axis, where the chute is configured to discharge snow from the snow thrower, a motor for rotating the chute, and a chute position user interface. The chute position user interface includes a first input device and a second input device. The motor is electrically controlled to rotate the chute. The motor ceases operation after receiving a response from the first input device and the motor continues operation after receiving a response from the second input device.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring in general to FIGS. 1-5, a control system for a snowthrower is an electronic control system configured to simplify the use of the snowthrower. The hand controls, including controls for drive engagement, drive speed and direction control, auger or impeller engagement, chute rotation, and deflector position, are positioned such that they may be operated without releasing the hand grips. The system reduces the amount of human effort required and complexity of operating a snow blower. It also reduces the amount of time it takes the user to complete various snow throwing tasks.

Figure 1:
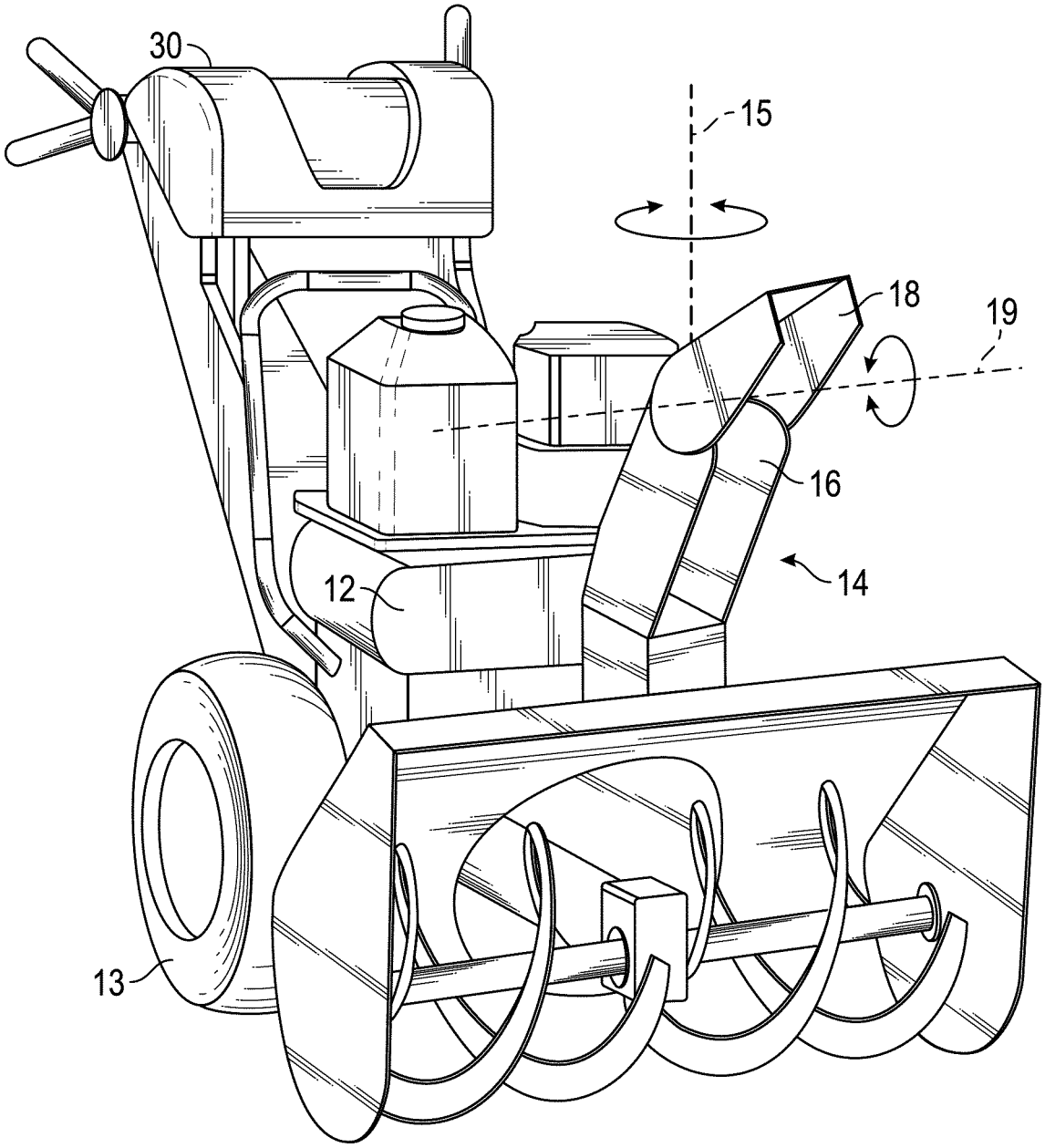
FIG. 1 is a perspective view of snowthrower, in accordance with an exemplary embodiment.

Referring to FIG. 1, a snowthrower 10 is illustrated. The snow thrower 10 includes a body 12, a chute 14 rotatable relative to the body 12, and a control interface 30 for controlling operation of various components of the snowthrower 10. The chute 14 includes a neck or main portion 16 rotatably coupled to the body 12 for rotation about a vertical axis 15. The chute 14 also includes a deflector 18 rotatably coupled to the neck 16 for rotation about a horizontal axis 19. Snow travels through the neck 16 and is discharged through the deflector 18. The direction of discharge is controlled by the position of the neck 16 relative to the body 12. The angle of discharge is controlled by the position of the deflector 18 relative to horizontal.

Figure 2:
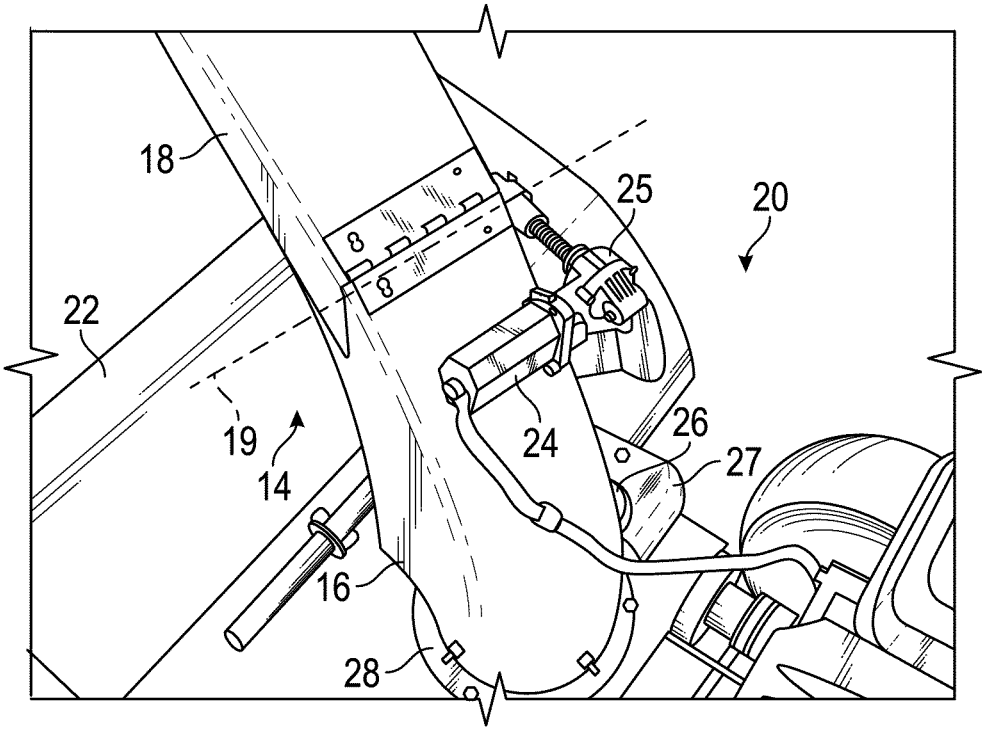
FIG. 2 is a perspective view of a portion of the snowthrower of FIG. 1.

Referring to FIG. 2, a perspective view of a portion of a snowthrower chute control system 20 in accordance with an exemplary embodiment is shown. The chute 14 is configured to direct snow gathered and propelled from an auger or impeller housing 22 as the snowthrower 10 is moved along a chosen path. The positioning of the chute 14 is controlled based on an input from the user to the control interface 30 via an electronic control unit (ECU) onboard the snowthrower 10. The ECU controls two motors (e.g., reversible DC motors) to control the position of the chute 14 and deflector 18. A first motor 24 is mounted on the chute 14 below the hinged deflector 18. The first motor 24 drives a connecting mechanism, such as a worm gear 25, to raise and lower the deflector 18. A second motor 26 is mounted at the base of the chute 14. The second motor 26 drives a connecting mechanism, such as a gear system 27, to rotate the chute 14 at a rotatable joint 28 to rotate the chute 14 in a user-selected direction.

Figure 3:
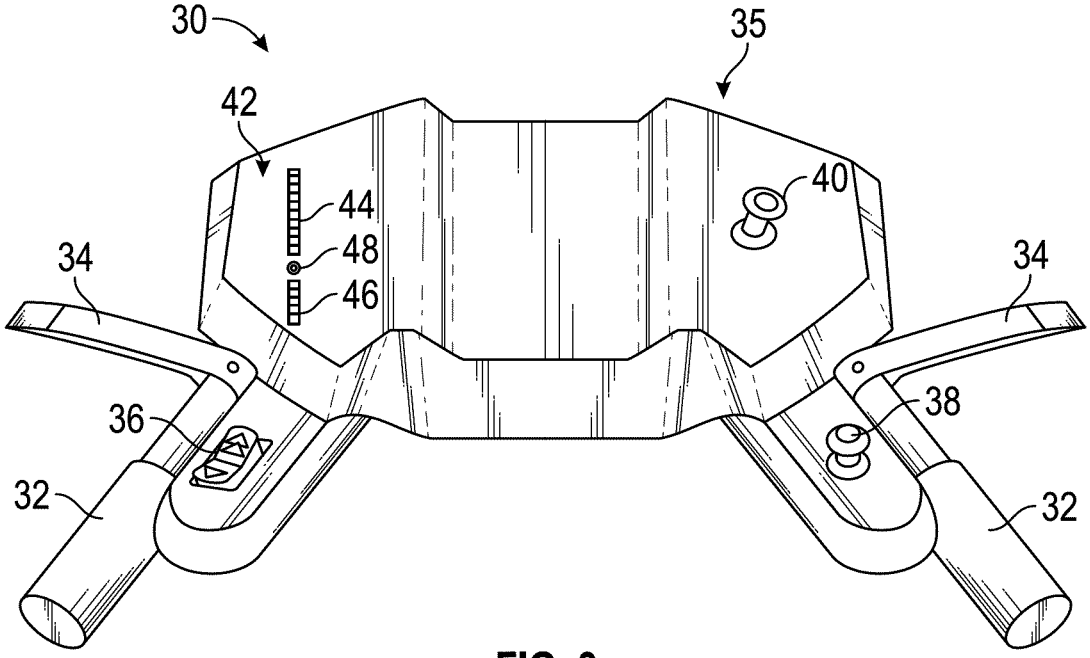
FIG. 3 is a perspective view of a control interface of the snowthrower of FIG. 1.

FIG. 3 illustrates the snowthrower control interface 30 in accordance with an exemplary embodiment. The control interface 30 includes a pair of handles 32 and drive levers 34. The drive levers 34 control the drive wheel engagement of the snowthrower and/or auger or impeller engagement. For example, the left handle 32 and drive lever 34 may control the auger and the right handle 32 and drive lever 34 may control the drive wheel 13 or vice versa. The drive levers 34 are positioned proximate to the handles 32 such that user can depress the drive levers 34 while grasping the handles 32. In other embodiments, other mechanisms may be utilized to detect the presence of the user's hands on the handles 32, such as pressure sensors.

The control interface 30 further includes a control panel 35 with one or more user interfaces or controls used to operate the snowthrower. Such controls may include, by way of example, a speed/direction control, shown as a rocker switch 36, and a chute direction/angle control, shown as a joystick 38. According to an exemplary embodiment, the controls are positioned proximate the handles 32 such that the user may operate the controls while maintaining a grip on the handles 32. In other embodiments, the controls may be otherwise placed, such as on the surface of the handles 32 or integrated into the handles 32.

An ignition switch 40 is provided to allow the user to start the prime mover (e.g., electric motor, internal combustion engine, diesel engine, etc.) of the snowthrower. According to an exemplary embodiment, the ignition switch 40 is a key switch. In other embodiments, the ignition switch may be another device, such as a push button, capacitive sensor(s), etc.

The speed and direction of the snowthrower is controlled by the rocker switch 36. According to an exemplary embodiment, the rocker switch 36 is positioned to the right of the left handle 32, allowing the user to operate the rocker switch 36 with the left thumb while keeping the left hand on the handle 32. The snowthrower may start in the neutral position. If the rocker switch 36 is pressed in the upward or forward direction, the speed of the snowthrower is increased in the forward direction. If the rocker switch 36 is pressed in the downward or rearward direction with the snowthrower moving forward, the speed of the snowthrower is decreased until the snowthrower is back in the neutral position. If the rocker switch 36 is pressed in the downward or rearward direction with the snowthrower in the neutral position, the speed of the snowthrower is increased in the reverse direction. If the rocker switch 36 is pressed in the upward or forward direction with the snowthrower moving in reverse, the speed of the snowthrower is decreased until the snowthrower is back in the neutral position. In other embodiments, the speed and direction of the snowthrower may be controlled with another device, such as individual buttons for the forward direction and the reverse direction, a dial, wheel, touchpad, or other suitable device.

The current speed and direction is relayed to the user via a speed indicator display 42 provided on the control panel 35. The speed indicator display 42 includes a first portion 44 corresponding to the forward speed of the snowthrower, a second portion 46 corresponding to a reverse speed of the snowthrower and a third portion 48 corresponding to the neutral position. According to an exemplary embodiment, the first portion 44 and second portion 46 are bar graphs formed by rows of LEDs, indicating the forward speed and the reverse speed of the snowthrower, respectively. The third portion 48 includes a single LED indicator disposed between the first portion 44 and the second portion 46. The speed indicator display 42 may be color-coded. For example, the LEDs of the first portion 44 may be a first color, such as green, the second portion 46 may be a second color, such as red, and the third portion 48 may be a third color, such as amber. In other embodiments, the speed indicator display 42 may be arranged differently, such as in an arc. In some embodiments, the speed indicator display 42 may be another device, such as a display screen.

The position of the chute 14 is controlled by the joystick 38. According to an exemplary embodiment, the joystick 38 is positioned to the left of the right handle 32, allowing the user to operate the joystick 38 with the right thumb while keeping the right hand on the handle 32. If the joystick 38 is held to the left, the chute 14 rotates to the left at the rotatable joint 28. If the joystick 38 is held to the right, the chute 14 rotates to the right at the rotatable joint 28. If the joystick 38 is held upward, the deflector 18 moves upward. If the joystick 38 is held downward, the deflector 18 moves downward. In other embodiments, the angle and direction of the chute 14 may be controlled with another device, such as individual joysticks for adjusting the horizontal and vertical angles, individual rocker switches for adjusting the horizontal and vertical angles, individual push buttons for adjusting the horizontal and vertical angles, one or more directional pads, touchpads, sliders, dials, buttons, switches, or other suitable devices.

Figure 4:
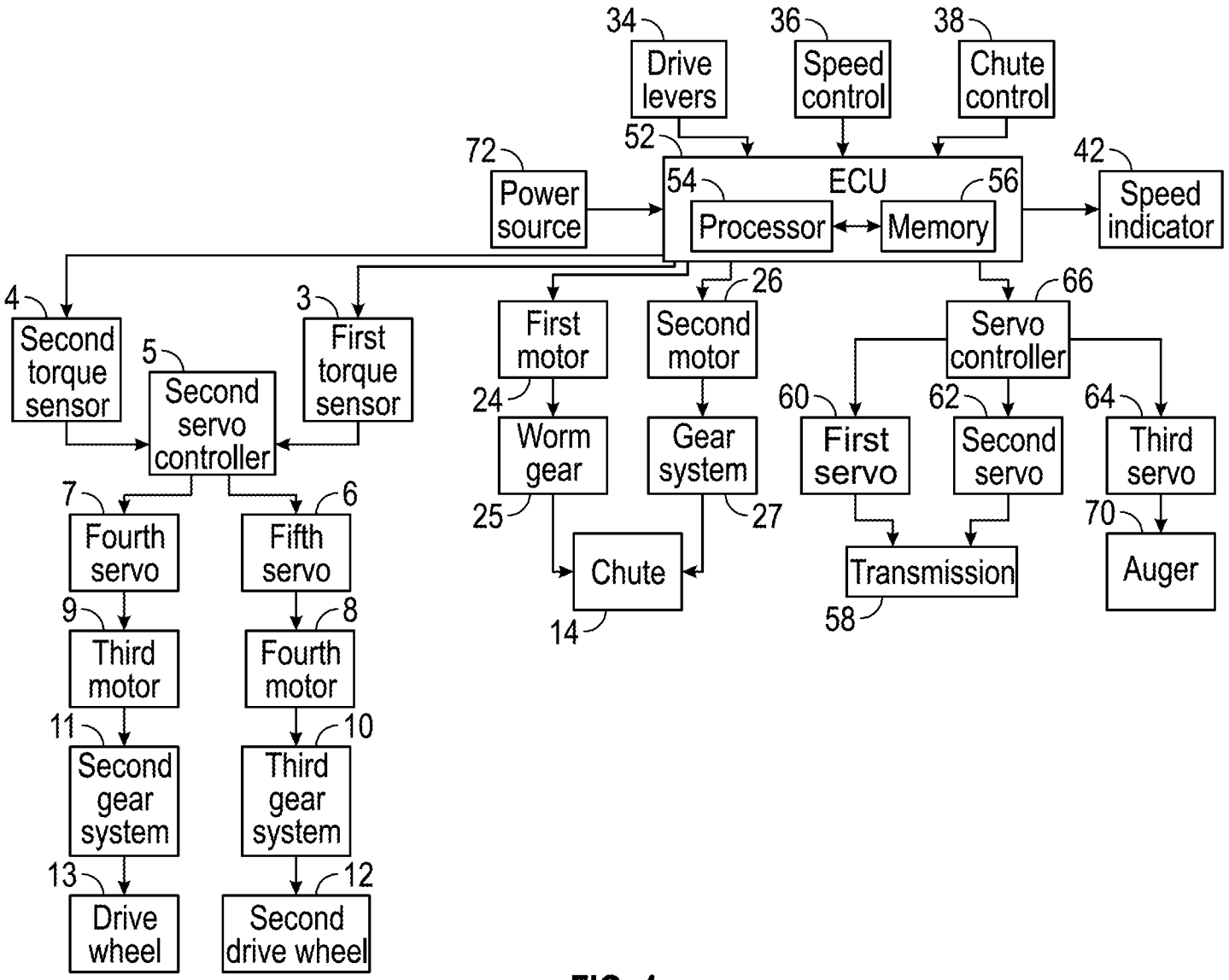
FIG. 4 is a block diagram of a control system of the snowthrower of FIG. 1.

Referring now to FIG. 4, a block diagram of a control system 50 for a snowthrower is shown according to an exemplary embodiment. The control system 50 includes the ECU 52 having a processor 54 and a memory device 56. The processor 54 can be implemented as a general purpose processor, an application specific integrated circuit (ASIC), one or more field programmable gate arrays (FPGAs), a group of processing components, or other suitable electronic processing components. The memory device 56 (e.g., memory, memory unit, storage device, etc.) is one or more devices (e.g., RAM, ROM, Flash memory, hard disk storage, etc.) for storing data and/or computer code for completing or facilitating the various processes, layers and modules described in the present application. The memory device 56 may be or include volatile memory or non-volatile memory. The memory device 56 may include database components, object code components, script components, or any other type of information structure for supporting the various activities and information structures described in the present application. According to an exemplary embodiment, the memory device 56 is communicably connected to the processor 54 and includes computer code for executing (e.g., by processing circuit and/or processor) one or more processes described herein.

The ECU 52 receives user input from the controls, including the rocker switch 36 and the joystick 38, and sends control signals to the motors 24 and 26. In one embodiment, the ECU 52 interfaces with the motors 24 and 26 via two optically isolated H-Bridges. The ECU 52 outputs a signal to the speed indicator display 42 indicating the drive mode (e.g., forward, neutral, reverse) and speed of the snowthrower.

The ECU 52 further sends control signals to servos 60, 62, and 64 that are used to control the various aspects of the snowthrower. The ECU 52 may communicate directly with the servos 60, 62, and 64 or may communicate with the servos 60, 62, and 64 via a servo controller 66. The first servo 60 controls the direction of movement of the snowthrower. In an exemplary embodiment, the first servo 60 has two predefined positions (e.g., forward and reverse). The second servo 62 is configured to control the speed of the snowthrower. According to an exemplary embodiment, the second servo 62, has multiple possible locations (e.g., 15 locations), which are determined by the speed the user chooses via the rocker switch 36. The first servo 60 and the second servo 62 may act upon a transmission 58 or another component of the snowthrower drivetrain. The third servo 64 engages and disengages an auger or impeller 70 from the prime mover. In an exemplary embodiment, the third servo 64 has two predefined positions (e.g., engaged and disengaged). The third servo 64 may activate in response to the user interaction with one or both of the drive levers 34. In various embodiments, the servos 60, 62, and 64 may be linear servos or rotary servos.

In various embodiments, the ECU 52 is configured to send information to a first torque sensor 3 and a second torque sensor 4. In these embodiments, a second servo controller 5 takes, stores, and processes this information into commands for a fourth servo 7 and a fifth servo 6. In these embodiments, the snowthrower 10 may have a drive wheel 13 and a second drive wheel 12. The drive wheel is powered through a second gear system 11 by a third motor 9 which is controlled through the fourth servo 7. The second drive wheel 12 is powered through a third gear system 10 by a fourth motor 8 which is controlled by the fifth servo 6. In alternative embodiments, the snowthrower may have only the drive wheel 13 and therefore need only a servo, a second servo controller 5, a second gear system 11 and a fourth servo 7. In these embodiments, the third motor 9 and the fourth motor 8 may take the form of any suitable motor (e.g., DC, hydraulic, AC, gasoline, etc.) In these embodiments, it would be possible to control the speed of the drive wheel 13 and/or the second drive wheel 12 in order to control the steering of the snowthrower. For instance, the first torque sensor 3 and the second torque sensor 4 will determine if the snowthrower is turning. If the snow thrower is turning, the second servo control will throttle the drive wheel and our second drive wheel 12 in accordance. The drive wheel 13 and the second drive wheel 12, will then steer the snowthrower through the use of the second gear system 11 and the third gear system 10. In these embodiments, a user would be able to cut along a curve because the servo controller would cause the outside wheel to speed up. These embodiments would allow for zero-radius turning as well as ninety-degree turns of the snowthrower.

The ECU 52, the motors 24 and 26, and the servos 60, 62, and 64 receive power from a power source 72. The power source 72 may be an on-board power source, such as a battery or an alternator driven by the prime mover. The power source 72 may be a removable, rechargeable battery (e.g., a lithium-ion battery).

In some embodiments, the control system 50 defaults to the neutral position and waits until user input is received to do anything. The firmware samples the data from the rocker switch 36 and the joystick 38. The data from the rocker switch 36 is used to set an appropriate flag. The flag is used to determine whether to increment or decrement a count that is used to keep track of both speed and direction. A case statement checks the count value and determines where to move the second servo 62 and what to display to the operator via the speed indicator display 42. State logic is also implemented to ensure that the rocker switch 36 is not stuck or is being held down inadvertently. The joystick 38 data is read as an analog signal and the value is used to determine which direction it is being held. A flag is then set and later in operation the firmware checks the flag and performs the necessary operation, (i.e. moving the chute 14 in the desired direction via the motors 24 and/or 26).

According to an exemplary embodiment, the control system 50 allows the user to operate some functions of the snowthrower, such as the speed/direction and the positioning of the chute 14, in both an incremental or manual mode and in an automatic mode.

In one embodiment, the rocker switch 36 may be pressed for a predetermined length of time in a direction opposite of the current direction of travel to return the snowthrower to a neutral position. For example, if the snowthrower is moving in a forward direction, the user may press the rocker switch 36 in a downward or rearward direction briefly to lower forward speed of the snowthrower incrementally or may press the rocker switch 36 in a downward or rearward direction for a predetermined length of time (e.g., 0.5 seconds, 1 second, 2 seconds, etc.), to return the snowthrower to the neutral position.

Figure 5:
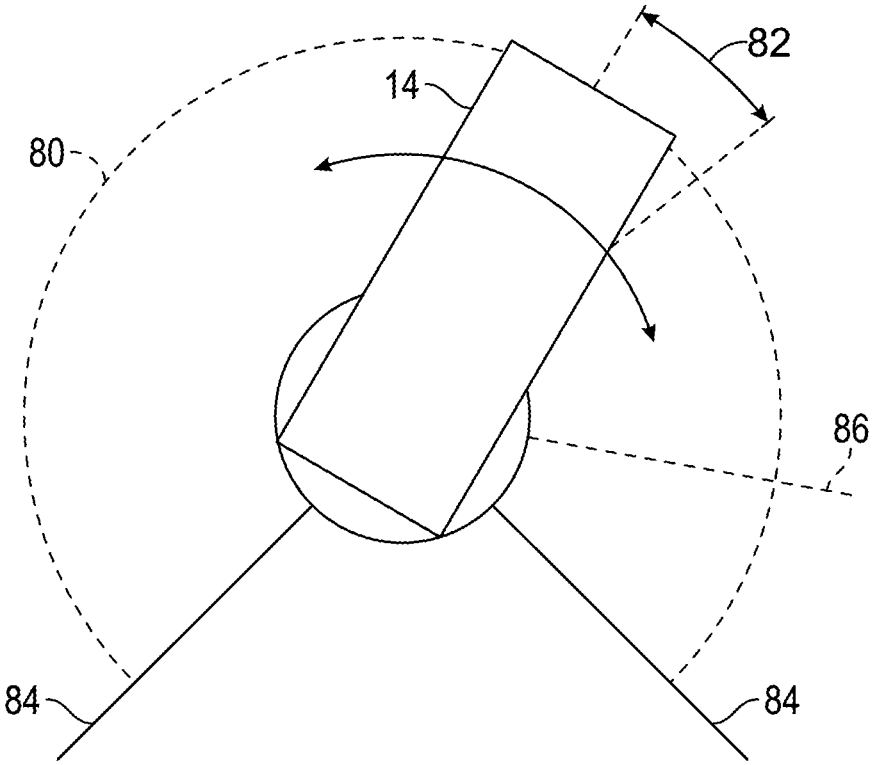
FIG. 5 is a schematic top view of a snowthrower, showing various positions of a chute along its range of motion, in accordance with an exemplary embodiment.

In another embodiment, the joystick 38 may be used to move the chute by an incremental amount or in a wider sweep. Referring to FIG. 5, a schematic overhead view of a chute 14 is shown, illustrating a range of motion 80 of the chute about the joint 28. In some embodiments, the range of motion is 210°. The chute 14 may be rotated about the joint 28 by an incremental amount 82 (e.g., an angular distance of 1°, 1.5°, 2°, 5°, etc.). The incremental amount 82 may be determined by the capabilities of the motor 26 and the gear system 27 connecting the motor 26 to the chute 14. The chute 14 may be moved by the incremental amount 82 by activating the joystick 38 or other control device to provide a first input to the ECU 52. In some embodiments, the first input may be provided by actuating the joystick for less than a predetermined amount of time (e.g., less than 0.5 seconds, 1 second, 2 seconds, etc.). In some embodiments, the first input may be provided moving a joystick of other user input device to a first position. In some embodiments, the first input may be provided by a first dedicated user input device (i.e., a chute incremental movement user interface).

The chute 14 may also be moved in a wider sweep about the joint 28. In some embodiments, the sweep moves the chute 14 to a predetermined position 86. For example, the predetermined position 86, may be the end 84 of the range of motion 80 of the chute 14. In some embodiments, the predetermined position 86 may be set by the manufacturer. For example, the predetermined position may be a set amount away from the current position of the chute 14 (e.g., an angular distance of 10°, 15°, 20°, 25°, 30°, 35°, 40°, 45°, etc.). In some embodiments, the predetermined position may be set by the user (e.g., by inputting the predetermined position through a user interface (i.e., a dedicated sweep set point user interface, pushing down on the joystick 38 along a vertical axis, etc.) and storing the predetermined position in the ECU 52 or by inputting a set angular distance away from the current position of the chute 14). In some embodiments, a sensor (e.g., a limit switch or presence sensor) may be provide at the ends 84 of the range of motion 80 of the chute 14 to provide a signal to the ECU 52 to stop rotation of the chute 14 without regard for the user input. The chute 14 may be moved in the wider sweep by activating the joystick 38 or other control device to provide a second input signal to the ECU 52. In some embodiments, the second input may be provided by actuating the joystick for longer than the predetermined amount of time (e.g., more than 0.5 seconds, 1 second, 2 seconds, etc.). In this way, a brief actuation of the joystick will result in incremental movement of the chute in the direction the joystick is actuated and a longer actuation of the joystick will result in a larger movement of the cute in the direction the joystick is actuated. The difference between the first input and the second input may be based on the length of the signal provided by the joystick 38 to the ECU 52. In some embodiments, the second input may be provided moving a joystick of other user input device to a second position different than the first position described above. The first position may be separated by detent or gate to provide a physical indication to the user of the two positions. In some embodiments, the second input may be provided by a second dedicated user input device (i.e., a chute incremental movement user interface) different than the first dedicated user input device (e.g. a pair of buttons, switches, locations on a touch screen, etc.).

In other embodiments, the response of the motors 24 and 26 or of the servos 60, 62, or 64 may be varied based on the force applied to the control devices (e.g., to move the switch past a detent) or based on the displacement of the control device. For example, the chute 14 may be rotated incrementally by the motor 26 by displacing the joystick 38 from a neutral position a small distance to a first position and may be moved in a wider sweep by displacing the joystick 38 from the neutral position a larger distance to a second position (e.g., the limit of the range of the joystick). In some embodiments, the first position is located between the neutral position and the second position. In some embodiments, the motors 24 and 26 are operable at variable speeds. For example, the motor 26 may rotate the chute 14 at a first speed in response to a first input provided by the joystick 38 and may rotate the chute 14 at a second speed greater than the first speed in response to a second input provided by the joystick 38.

In other embodiments, separate inputs may be provided allow a user to direct the operation of the motors 24 and 26 or the servos 60, 62, and 64 in various modes. For example, instead of the joystick 38, the control interface 30 may include multiple separate buttons to rotate the chute 14 about the rotatable joint 28, such as individual buttons for clockwise incremental, counterclockwise incremental, clockwise sweep, and counterclockwise sweep movement; or separate rocker switches for incremental movement and for sweep movement.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A snow thrower comprising:

a body;

a chute rotatable relative to the body about an axis, wherein the chute is configured to discharge snow from the snow thrower;

a chute motor for rotating the chute; and a chute position user interface;

wherein the chute motor is electrically controlled to rotate the chute in response to a first input duration to the chute position user interface, and wherein the chute motor is electrically controlled to rotate the chute in response to a second input duration to the chute position user interface;

wherein the chute motor ceases operation after the first input duration, and wherein the chute motor continues operation after the second input duration.

2. The snow thrower of claim 1, wherein the chute position user interface comprises a joystick.

3. The snow thrower of claim 1, wherein the first input duration is provided upon actuation of the chute position user interface for less than a predetermined amount of time and wherein the second input duration is provided upon actuation of the chute position user interface for at least the predetermined amount of time.

4. The snow thrower of claim 1, further comprising:

a drive wheel rotatably coupled to the body;

a speed/direction user interface;

a speed servo configured to control a speed of the drive wheel; and a direction servo configured to control a direction of the drive wheel; and an electronic control unit configured to control the speed servo and the direction servo in response to receiving an input from the speed/direction user interface.

5. The snow thrower of claim 4, further comprising:

a speed indicator display for displaying the speed and the direction of the drive wheel to a user.

6. A snow thrower comprising:

a body;

a chute rotatable relative to the body about an axis, wherein the chute is configured to discharge snow from the snow thrower;

a motor for rotating the chute; and a chute position user interface;

wherein the motor is electrically controlled to rotate the chute in response to a first input duration to the chute position user interface, and wherein the motor is electrically controlled to rotate the chute in response to a second input duration to the chute position user interface;

wherein the motor ceases operation after the first input duration, and wherein the motor continues operation after the second input duration.

7. The snow thrower of claim 6, wherein the first input duration and the second input duration are different.

8. The snow thrower of claim 7, wherein the first input duration is shorter than the second input duration.

9. The snow thrower of claim 6, wherein the chute position user interface comprises a joystick.

10. The snow thrower of claim 6, wherein the first input duration is provided upon actuation of the chute position user interface for less than a predetermined amount of time and wherein the second input duration is provided upon actuation of the chute position user interface for at least the predetermined amount of time.

11. The snow thrower of claim 6, further comprising:

a drive wheel rotatably coupled to the body;

a speed/direction user interface;

a speed servo configured to control a speed of the drive wheel; and a direction servo configured to control a direction of the drive wheel; and an electronic control unit configured to control the speed servo and the direction servo in response to receiving an input from the speed/direction user interface.

12. A snow thrower comprising:

a body;

a chute rotatable relative to the body about an axis, wherein the chute is configured to discharge snow from the snowthrower;

a motor for rotating the chute; and a chute position user interface comprising a first input device and a second input device;

wherein the motor is electrically controlled to rotate the chute;

wherein the motor ceases operation after receiving a response from the first input device;

wherein the motor continues operation after receiving a response from the second input device.

13. The snow thrower of claim 12, wherein the first input device comprises a first button and the second input device comprises a second button.

14. The snow thrower of claim 12, wherein the motor is electrically controlled to rotate the chute in an incremental movement in response to the first input, and wherein the motor is electrically controlled to rotate the chute in a sweep movement in response to the second input.

* * * * *